US011542734B1

(12) United States Patent
Gunkler

(10) Patent No.: US 11,542,734 B1
(45) Date of Patent: Jan. 3, 2023

(54) APPARATUS AND METHOD FOR A DOOR LATCHING MECHANISM

(71) Applicant: Latch A Door Products, LLC, Benson, NC (US)

(72) Inventor: Thomas Matthew Gunkler, Benson, NC (US)

( * ) Notice: Subject to any disclaimer, the term of this patent is extended or adjusted under 35 U.S.C. 154(b) by 129 days.

(21) Appl. No.: 17/021,634

(22) Filed: Sep. 15, 2020

Related U.S. Application Data

(63) Continuation of application No. 29/750,124, filed on Sep. 11, 2020.

(51) Int. Cl.
*E05C 17/02* (2006.01)
*E05C 17/04* (2006.01)
*E05C 19/18* (2006.01)

(52) U.S. Cl.
CPC ..... *E05C 17/02* (2013.01); *E05C 17/04* (2013.01); *E05C 19/182* (2013.01); *E05Y 2900/132* (2013.01)

(58) Field of Classification Search
CPC ..... E05C 17/166; E05C 17/52; E05C 17/36; E05C 19/18; E05C 19/188; E05C 17/54; E05C 17/047; E05C 17/30; E05C 19/184; E05C 17/04; E05B 17/0041; A63B 21/1645
See application file for complete search history.

(56) References Cited

U.S. PATENT DOCUMENTS 398,439 A * 2/1889 Parsons ..... E05C 17/04 292/91
409,194 A * 8/1889 Hardy ..... E05C 17/04 292/91
758,998 A * 5/1904 Miller ..... E05C 17/54 292/344
827,624 A * 7/1906 Foster ..... E05C 19/18 292/288
1,057,976 A * 4/1913 Peppers ..... E05C 17/04 292/91
1,108,894 A * 9/1914 Fatherree ..... E05C 17/04 292/91
1,166,692 A * 1/1916 Kennedy ..... E05C 19/182 292/292
1,532,737 A * 4/1925 Dohrmann ..... E05C 17/20 292/278
1,736,602 A * 11/1929 Kenerson ..... E05C 17/52 292/76
2,858,617 A * 11/1958 Marchetti ..... E05B 17/06 33/194

(Continued)

FOREIGN PATENT DOCUMENTS

FR 522844 A * 8/1921 ..... E05C 17/52

*Primary Examiner* — Jonathan Liu
*Assistant Examiner* — Taylor Morris

(57) ABSTRACT

The present inventive concept provides a door holding and/or a door latching apparatus including an elongated door latch bracket including a first end that is affixed to an area on a door frame that extends toward a substantially U-shaped door latch portion for engaging with and holding the edge of a door, wherein the U-shaped door latch portion extends toward a second end including a tab or flap member for flexing the bracket for engaging or disengaging the door with or from the U-shaped door latch portion and methods of using the same.

5 Claims, 4 Drawing Sheets

(56) References Cited

U.S. PATENT DOCUMENTS 3,593,996 A * 7/1971 Thompson ..... A63B 1/005 482/40
3,640,558 A * 2/1972 Gewertz ..... E05C 17/365 292/264
3,717,357 A * 2/1973 Schaefer ..... B62B 5/0083 280/47.131
3,758,141 A * 9/1973 Weinberger ..... E05C 17/54 16/DIG. 40
4,130,309 A * 12/1978 Lewis ..... E05C 19/182 292/258
4,134,608 A * 1/1979 Pool ..... E05C 17/52 292/DIG. 19
4,471,981 A * 9/1984 Wright ..... E05C 19/182 292/295
4,475,753 A * 10/1984 D'Ath ..... E05C 17/166 D10/104.1
4,770,451 A * 9/1988 Souza ..... E05C 19/182 292/288
4,809,400 A * 3/1989 Allen ..... E05B 15/0205 70/451
5,127,690 A * 7/1992 Kim ..... E05B 15/0245 292/DIG. 60
5,547,236 A * 8/1996 Gregory ..... E05C 19/182 292/288
5,566,993 A * 10/1996 Olivas ..... E05C 19/182 292/288
5,577,783 A * 11/1996 Kaminski ..... E05C 17/166 292/270
6,016,588 A * 1/2000 Kamerschen ..... E05C 17/52 16/85
6,345,849 B1 * 2/2002 Yen ..... E05C 17/54 292/342
6,550,828 B2 * 4/2003 Warden ..... E05C 17/54 292/288
6,755,450 B1 * 6/2004 Chen ..... E05C 19/182 292/289
7,226,094 B2 * 6/2007 Swink ..... E05C 17/50 292/DIG. 19
7,360,809 B1 * 4/2008 Poston ..... E05B 15/0205 292/346
7,452,011 B1 * 11/2008 Lind ..... E05C 17/36 292/87
8,176,962 B2 * 5/2012 Kilfoyle ..... E06B 7/32 160/180
8,376,422 B2 * 2/2013 Swink ..... E05C 17/52 292/288
8,505,168 B1 * 8/2013 Chapman ..... E05D 11/00 160/40
8,783,740 B1 * 7/2014 Hurt ..... E05C 17/18 292/270
9,316,033 B2 * 4/2016 Yates ..... E05C 17/54
9,752,350 B2 * 9/2017 Davis ..... E05F 5/00
10,041,273 B2 * 8/2018 Dieguez ..... E05C 19/182
10,501,968 B2 * 12/2019 Maher ..... E05C 17/08
10,961,747 B1 * 3/2021 Myers ..... E05B 65/0075
2002/0067046 A1 * 6/2002 Cox, Sr. ..... E05C 19/184 292/289
2004/0026935 A1 * 2/2004 Tang ..... E05C 19/184 292/292
2006/0279093 A1 * 12/2006 Tang ..... E05C 17/166 292/288
2007/0085352 A1 * 4/2007 Ulanday ..... E05C 17/365 292/288
2008/0264119 A1 * 10/2008 Thomas ..... E05C 3/048 70/77
2011/0192092 A1 * 8/2011 Scott ..... E05C 3/048 70/91
2015/0097382 A1 * 4/2015 Blawat ..... E05C 17/56 292/288
2020/0102774 A1 * 4/2020 Maher ..... E05C 17/047
2020/0362607 A1 * 11/2020 Srnoyachki ..... E05B 15/0046
2022/0042358 A1 * 2/2022 Gordon ..... E05C 17/52

* cited by examiner

SECTION A-A

APPARATUS AND METHOD FOR A DOOR LATCHING MECHANISM

CROSS REFERENCE TO RELATED APPLICATION

The present application is a continuation application of U.S. patent application Ser. No. 29/750,124, filed Sep. 11, 2020, the contents of which are incorporated herein by reference in its entirety.

FIELD

The present inventive concept relates to a door latch or latching mechanism for holding a door open or closed a certain distance and a method for holding a door and a latching mechanism designed to hold a door open or closed at a prescribed distance.

BACKGROUND

For pet owners, there is a need to keep doors open so cats do not get trapped in rooms, and so dogs do not have access to the cat's litter. There is a need for a door latching device to hold a door so dogs cannot open the door by jumping on the door, while holding the door open enough for cats to pass through the door and also closed enough to keep average-sized dogs out. Moreover, the door latch mechanism should be sturdy so as to withstand a door slamming into the device, and the door latch should permit the door to open and close fully when desired without the need to remove the device.

A reliable door latch is also needed to assist with other tasks such as keeping children out of various areas, preventing children from pinching their fingers in closing doors and maintaining doors open for more efficient heating and/or cooling.

Generally, prior art devices fail to provide a sturdy door holding and/or latching mechanism that can hold a door open or closed at a prescribed distance along any point of the door frame.

Hence, there is a need for a sturdy door holding and/or latching mechanism designed to hold a door open or closed at a prescribed distance.

SUMMARY OF THE INVENTION

The present inventive concept provides a door holding and/or a door latching apparatus and method that holds a door so larger pets (greater than 50 pounds) e.g., dogs, cannot open the door by jumping on the door, while holding the door open enough for smaller pets (less than 20 pounds), e.g., cats and smaller dogs, to pass through the door and also closed enough to keep average-sized pets (around 40 pounds), e.g., dogs, out as well as keeps children out of dangerous areas, protects children from pinching their fingers in closing doors and also keeps doors held open for more efficient heating and/or cooling. The door latch is also sturdy enough to withstand a door slamming into the device, and the door latch permits the door to open and close fully when desired without the need to remove the device. The door latch device also obviates the need to modify or cut a hole in an existing door or purchase a special door to allow the ingress and egress of small pets.

In some embodiments, the presently disclosed door latch and method provide an elongated, substantially flat door latch bracket including a first end that may be fastened to the doorjamb, and wherein the first end extends toward a substantially U-shaped door latch portion for engaging with and holding the edge of a door, and wherein the U-shaped door latch portion extends toward a second end including a tab or flap member for flexing the bracket for engaging/disengaging the door with/from the U-shaped door latch portion of the device.

Further embodiments of the present inventive concept provide a door holding and/or a door latching apparatus including a first member including at least one aperture, wherein the first member is configured to affix to an area on a door frame; and a second member including at least one aperture, wherein the second member further includes an edge curved in an outward direction, wherein the first and second members include an overlapping aperture and are connected to each other by a fastener through the overlapping aperture and the connection of the first and second members provide an area to receive the door.

Accordingly, in some embodiments, the presently disclosed door latch and method provide a two-piece door latch bracket for holding a door open a certain amount that is adjustable, such as adjustable from about 3.5 inches open to about 4.5 inches open.

In some embodiments, the presently disclosed door latch and method provide a one-piece door latch bracket for holding a door open a certain fixed amount, such as, but not limited to, a fixed 3.5 inches, 4 inches, or 4.5 inches open.

Embodiments of the present inventive concept provide a method for holding or latching a door including (a) providing a door holding and/or a door latching apparatus mounted to a door jamb or replacing a door strike plate, wherein the door holding and/or a door latching apparatus includes (i) a first member including at least one aperture, wherein the first member is configured to affix to an area on a door frame; and (ii) a second member including at least one aperture, wherein the second member further includes an edge curved in an outward direction, wherein the first and second members include an overlapping aperture and are connected to each other by a fastener through the overlapping aperture and the connection of the first and second members provide an area to receive the door; and placing the door in a desired position.

Embodiments of the present inventive concept satisfy the need for a door holding and latching device that is flexible, yet sturdy and made of a durable material that is mounted in place of the existing door strike plate or anywhere in the internal door frame capable of holding the door at a prescribed distance with a custom adjustment capability.

DETAILED DESCRIPTION

Figure 1:
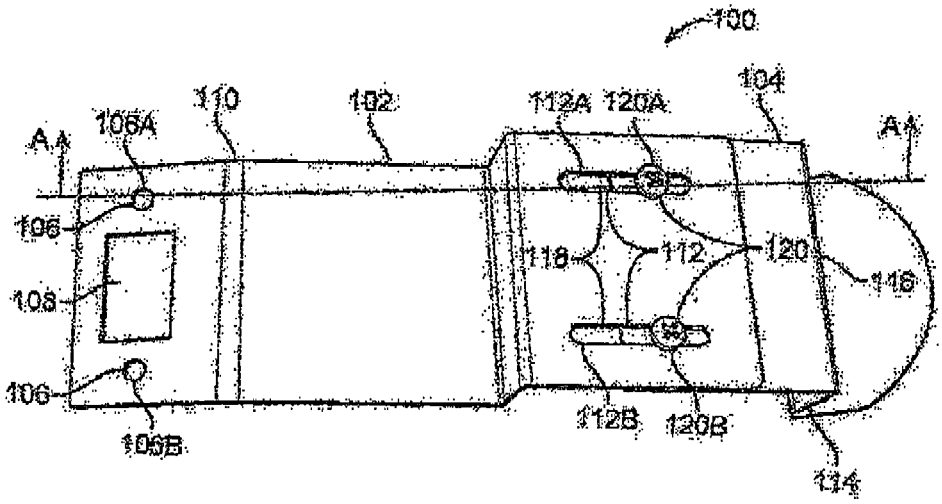
FIG. 1 illustrates a perspective view of an exemplary embodiment of a door holding and latching device in accordance with an exemplary embodiment of the present inventive concept.

The foregoing and other features of embodiments of the present inventive concept will become more apparent from the following detailed description of embodiments when read in conjunction with the accompanying drawings. In the drawings, like reference numerals refer to like elements.

The present inventive concept provides embodiments of a door holding and/or latching mechanism designed to hold a door open or closed at a prescribed distance.

An aspect the present inventive concept is to provide a door holding and/or latching mechanism that is mountable in place of an existing door strike plate or anywhere in the internal door frame. In particular embodiments, the door holding and/or latching mechanism is provided with an adjustment capability. The adjustment capability includes fasteners that allow the device components to connect and subsequently hold a door open or closed at a prescribed distance.

In some embodiments, the presently disclosed door latch and method provide an elongated, substantially flat door latch bracket including a first end that may be fastened to the doorjamb, and wherein the first end extends toward a substantially U-shaped door latch portion for engaging with and holding the edge of a door, and wherein the U-shaped door latch portion extends toward a second end including a tab or flap member for flexing the bracket for engaging/disengaging the door with/from the U-shaped door latch portion.

In some embodiments, the presently disclosed door latch and method provide a one-piece (i.e., contiguous, non-multi component) door latch bracket for holding a door open a certain fixed amount, such as, but not limited to, a fixed 2.5 inches, 3.0 inches, 3.5 inches, 4 inches, 4.5 inches, 5.0 inches, 5.5 inches, 6.0 inches (and any measurement in between) open. In particular embodiments, the opening is 3.5 to 4.5 inches.

In some embodiments, the presently disclosed door latch and method provide at least a two-piece door latch bracket for holding a door open a certain amount that is adjustable, such as adjustable from about 1.0 inches to about 2.0 inches and any measurement in between.

In some embodiments where the presently disclosed door latch and method provide a two-piece door latch bracket, the two bracket pieces are adjustably coupled at the U-shaped door latch portion. For example, a first piece is provided that forms the first end that may be fastened to the doorjamb and then extends and forms the leading half of the U-shaped door latch portion. Then, a second piece is provided that forms the trailing half of the U-shaped door latch portion and then extends and forms the second end including the tab or flap member. Further, the leading half of the U-shaped door latch portion of the first piece overlaps and couples in adjustable fashion to the trailing half of the U-shaped door latch portion of the second piece.

In some embodiments, the presently disclosed door latch and method provide a door latch bracket that extends from the doorjamb toward the inward opening side or hinged side of the door.

In some embodiments, the presently disclosed door latch and method provide a door latch bracket in which the opening of the U-shaped door latch portion faces the door hinges.

In some embodiments, the presently disclosed door latch and method provide a door latch bracket that can be flexibly released by hand, foot or other extension mechanism when approaching from either side of the door.

In some embodiments, the presently disclosed door latch and method provide a door latch bracket that may be installed suitably high on the door to be operable by taller individuals, such as some adults only, and out of reach by smaller children and/or pets.

In some embodiments, the presently disclosed door latch and method provide a door latch bracket formed of a suitably strong, rigid, but slightly flexible material, such as, but not limited to, metal, plastic, composite material, and the like as discussed below.

In some embodiments, the presently disclosed door latch and method provide a door latch bracket that is suitably thin so as to not interfere with the doorjamb when closing the door fully shut.

In some embodiments, the presently disclosed door latch and method for holding a door open a certain amount may be used to allow a small animal, such as a cat, to enter a room or space while at the same time blocking a larger animal, such as a larger dog, or a child from entering the same room or space.

In some embodiments, the presently disclosed door latch and method for holding a door open a certain amount may be used to enhance air circulation in a building or space.

In some embodiments, a method of using the presently disclosed door latch for holding a door open a certain amount may include, but is not limited to, any or all of the steps of (1) fully opening the door, (2) affixing the first end of the door latch bracket to the doorjamb with the door latch bracket extending from the doorjamb toward the inward opening side of the door and with the opening of the U-shaped door latch portion facing the door hinges. (3) adjusting the door latch bracket for a desired amount of door opening, such as from about 2.5 inches to about 5.0 inches open, (4) closing the door such that the door edge engages with and is held by the U-shaped door latch portion of the door latch bracket, and (5) flexing the door latch bracket to release the door from the U-shaped door latch portion to either fully open or fully close the door.

Referring to FIGS. 1-6, the door holding and/or latching device is illustrated in accordance with an exemplary embodiment of the present invention. As illustrated, the door holding and/or latching device includes a first member and a second member in connection with each other wherein the device holds the door open or closed at a prescribed distance.

FIG. 1 illustrates an exemplary embodiment of a door holding and/or latching device 100 in accordance with the present inventive concept. The door holding and/or latching device 100 includes first member 102 and second member 104. The first member 102 of the door holding and/or latching device 100 replaces an existing door strike plate or is affixed anywhere in the internal frame pocket of the door. In this present embodiment, the second member 104 is affixed to the free end of the first member 102.

In this exemplary embodiment, the first member 102 of the door holding and/or latching device 100 having holes 106 (e.g., first hole 106A and second hole 106B) are provided at one end of the first member 102 to install a fastener with the door holding and/or latching device 100 to affix with the internal frame pocket of the door. The fastener may be a nail, screw, clip, adhesive, etc. An opening 108 is provided in between the holes 106 at the same end of the first member 102 of the door holding and/or latching device 100 to replace the existing door strike plate or anywhere in the internal frame pocket of the door. In particular embodiments, the first member 102 is slightly inclined to provide an angled area 110 to provide better flexibility for quieter operation, safety from sharp or square edges, and universal use with different types of door frame configurations.

In the present embodiment, the opening 108 provided in between the two holes 106 (first hole 106A and second hole 106B) in the first member 102 of the door holding and/or latching device 100 can be of any geometric shape such as rectangular, square, triangular, circular, etc. that can be included in the first member 102. The first member may also include an additional opening that can be used to support an item on the door holding and/or latching device, for example, a clothes hanger, a hook, etc.

In this exemplary embodiment, the second member 104 of the door holding and/or latching device 100 is designed with a leading edge 114 with an angled area 116 curved outwards to receive the door. The second member 104 of the door holding and latching device 100 is provided with the holes (not shown in FIG. 1) to connect with the free end of the first member 102 using fasteners 120 (fastener A 120A and fastener 120B). The fastener can be one or a combination of a screw, nail, clip, adhesive, etc.

According to this embodiment, combining the first member 102 of the door holding and latching device 100 with the second member 104 of the door holding and latching device 100 by connecting the free end of the first member 102 of the door holding and latching device 100 having two slots 112 (Slot A 112A and Slot B 112B) with the holes (not shown in FIG. 1) of the second member 104 of the door holding and latching device 100 using the screws 120 (Screw A 120A and Screw B 120B) for each slot 112 (Slot A 112A and Slot B 112B) to provide an adjustment capability 118 between the first member 102 and the second member 104 of the door holding and/or latching device 100 to hold the door open or closed at the prescribed distance.

Figure 2:
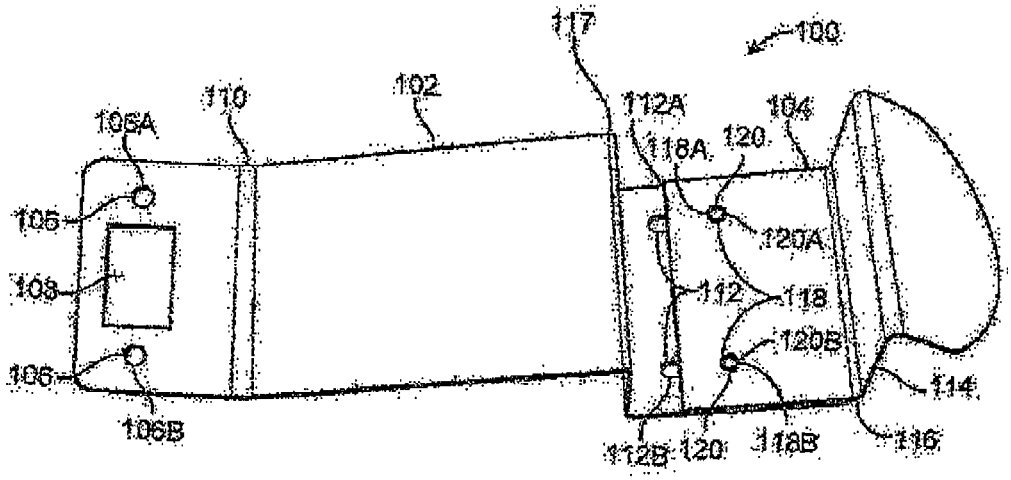
FIG. 2 illustrates an inverted view of an exemplary embodiment of the door holding and latching device in accordance with an exemplary embodiment of the present inventive concept.

FIG. 2 illustrates an inverted view of an exemplary embodiment of a door holding and/or latching device 100 in accordance with an exemplary embodiment of the present inventive concept. The door holding and/or latching device 100 includes first member 102 and second member 104. The first member 102 of the door holding and latching device 100 can replace an existing door strike plate or be affixed anywhere in an internal frame pocket of the door. In this present embodiment, the second member 104 is fixed to the free end of the first member 102.

In this exemplary embodiment, the first member 102 of the door holding and latching device 100 having holes 106 (First hole 106A and Second hole 106B) are provided at one end of the first member 102 to install crews with the door holding and/or latching device 100 to fix with the internal frame pocket of the door. An opening 108 is provided in between the holes 106 at the same end of the first member 102 of the door holding and/or latching device 100 to fix with the existing door strike plate or anywhere in the internal frame pocket of the door. The first member 102 can be slightly inclined to provide an angled are 110 to provide better flexibility for quieter operation, safety from sharp edges and universal use.

According to FIG. 2, the opening 108 provided in between the two holes 106 (First hole 106A and Second hole 106B) in the first member 102 of the door holding and/or latching device 100 can be of any shape such as rectangular, square or circular.

In this exemplary embodiment, the second member 104 of the door holding and/or latching device 100 is designed with a leading edge 114 with an angled area 116 curved outwards to receive the door. The second member 104 of the door holding and/or latching device 100 is provided with the holes 118 (First hole 118A and Second hole 118B) to connect with the free end of the first member 102 using, for example, screws 120 (Screw A 120A and Screw B 120B).

Referring to FIG. 2, combining the first member 102 of the door holding and/or latching device 100 with the second member 104 of the door holding and/or latching device 100 by connecting the free end of the first member 102 of the door holding and/or latching device 100 having two slots 112 (Slot A 112A and Slot B 112B) with the holes 118 (First hole 118A and Second hole 118B) of the second mender 104 of the door holding and/or latching device 100 using the screws 120 (Screw A 120A and Screw B 120B) for each slot 112 (Slot A 112A and Slot 112B).

Figure 3:
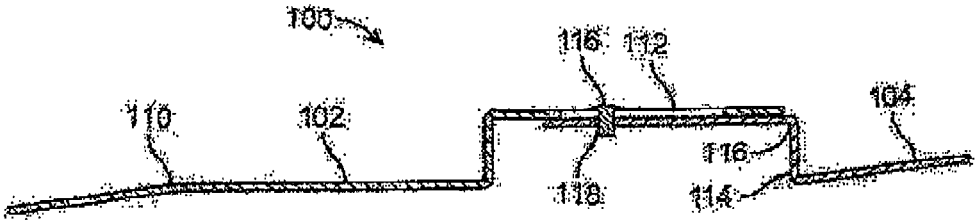
FIG. 3 illustrates a cross-sectional view of an exemplary embodiment of the door holding and latching device in accordance with an exemplary embodiment of the present inventive concept.

FIG. 3 illustrates across-sectional view of an exemplary embodiment of a door holding and/or latching device in accordance with an exemplary embodiment of the present inventive concept. The door holding and/or latching device 100 includes first member 102 and second member 104. The first member 102 of the door holding and/or latching device 100 is fixed to an existing door strike plate replacing the same or anywhere in internal frame pocket of the door. In this present embodiment, the second member 104 is fixed to free end of the first member 102.

In this exemplary embodiment, the first member 102 of the door holding and/or latching device 100, the first member 102 can be slightly inclined to provide an angled area 110 to provide better flexibility for quieter operation, safety from sharp or square edges, and universal use. In the second member 104 of the door holding and/or latching device 100, designing a leading edge 114 with an angled area 116 curved outwards to receive the door. The second member 104 of the door holding and/or latching device 100 is provided with the holes 112 to connect with the free end of the first member 102 using fasteners 116.

According to the FIG. 3, combining the first member 102 of the door holding and/or a latching device 100 with the second member 104 of the door holding and/or latching device 100 by connecting the free end of the first member 102 of the door holding and/or latching device 100 through the holes 112 of the second member 104 of the door holding and/or latching device 100 using the fasteners 116 to provide an adjustment capability 114 between the first member 102 and the second member 104 of the door holding and/or latching device 100 to hold the door open or closed at the prescribed distance.

Figure 4:
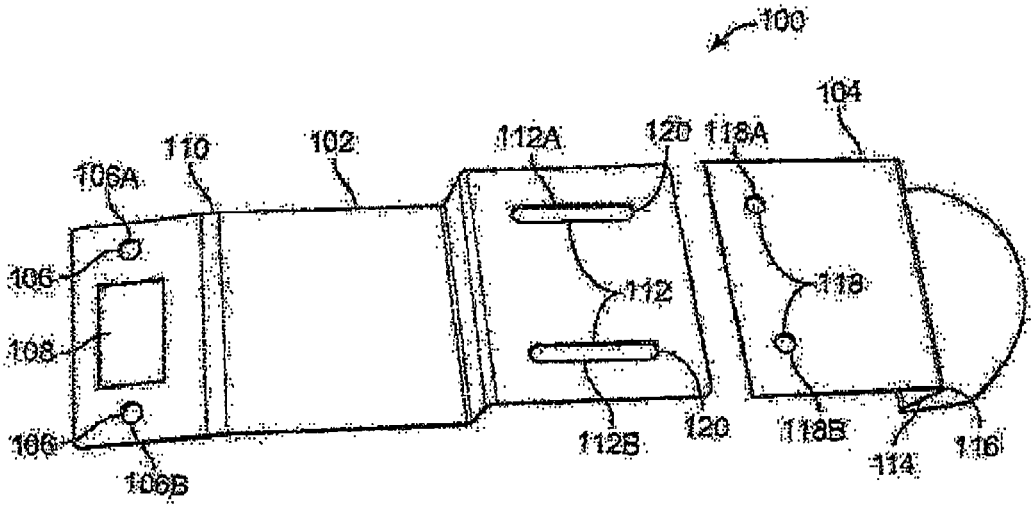
FIG. 4 illustrates a view of an exemplary embodiment of the door holding and latching device with isolated first and second members of the door holding and latching device in accordance with an exemplary embodiment of the present inventive concept.

FIG. 4 illustrates a view of an exemplary embodiment of a door holding and/or latching, device 100 with isolated first member 102 and second member 104 of the door holding and/or latching device 100 in accordance with an exemplary embodiment of the present inventive concept. In the first member 102 of the door holding and/or latching device 100, holes 106 (First hole 106A and Second hole 106B) are provided at one end of the first member 102 to install screws with the door holding and/or latching device 100 to fix with an existing door strike plate already fixed in internal frame pocket of the door. An opening 108 is provided in between the holes 106 at the same end of the first member 102 of the door holding and/or latching device 100 to fix with the existing door strike plate or anywhere in the internal frame pocket of the door. The first member 102 is slightly inclined to provide an angled area 110 to provide better flexibility for quieter operation, safety from sharp or square edges and universal use.

In this present embodiment, the opening 108 provided in between the two chamfered holes 106 (First chamfered hole 106A and Second chamfered hole 106B) in the first member 102 of the door holding and/or latching device 100 can be of any shape such as rectangular, square or circular.

Referring to FIG. 4, the first member 102 of the door holding and/or latching device 100 contains two slots 112 (Slot A 112A and Slot B 112B). The slots 112 of the first member 102 are used to provide an adjustment capability 120.

In this exemplary embodiment, the second member 104 of the door holding and/or latching device 100 is designed with a leading edge 114 with an angled area 116 curved outwards to receive the door. The second member 104 of the door holding and/or latching device 100 is provided with holes 118 (First hole 118A and Second hole 118B).

Figure 5:
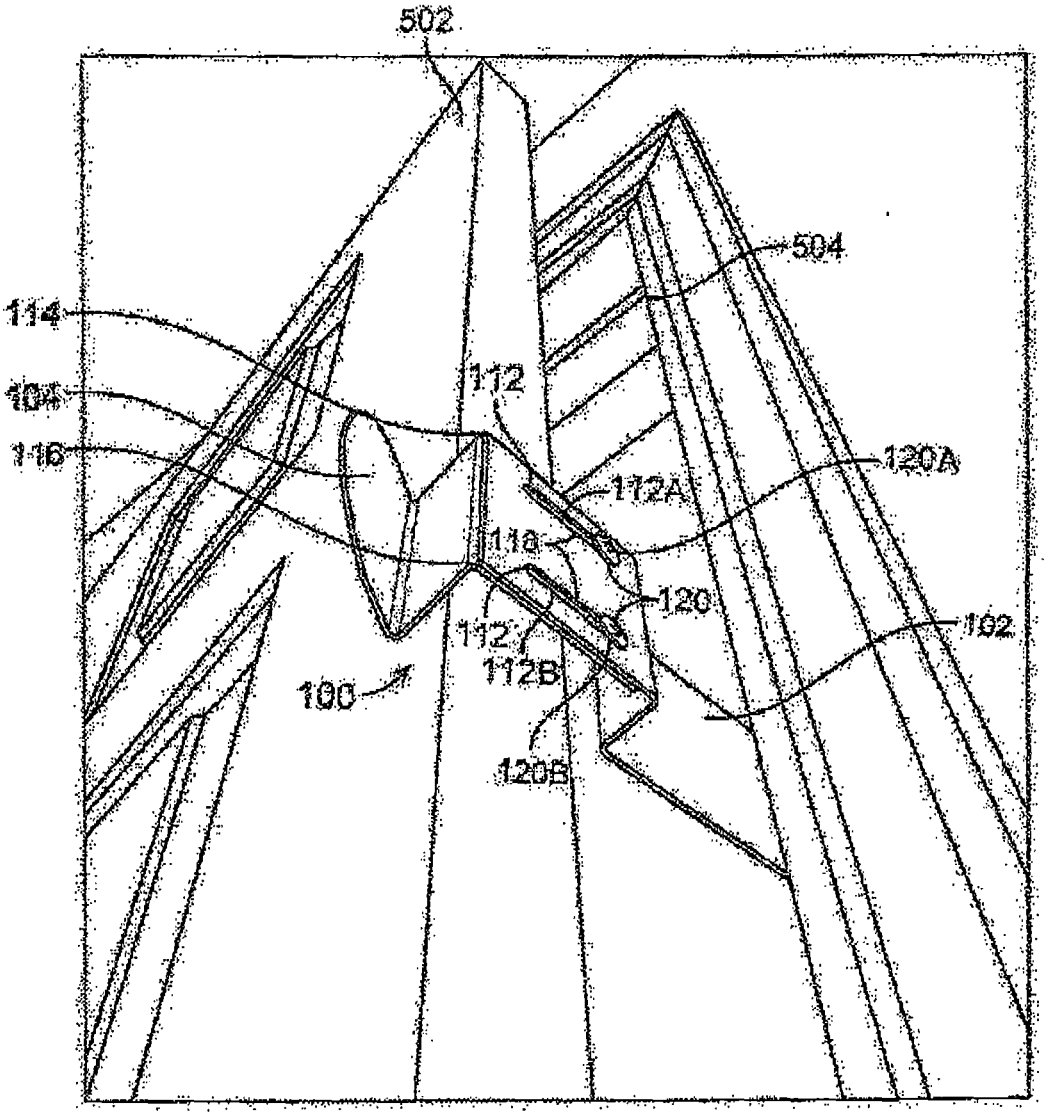
FIG. 5 illustrates a view of an exemplary embodiment of an arrangement of holding the door with the door latching device in accordance with an exemplary embodiment of the present inventive concept.

FIG. 5 illustrates a view of an exemplary embodiment of an arrangement of holding a door 502 with a door latching device 100 in accordance with an exemplary embodiment of the present inventive concept. The door holding and/or latching device 100 includes first member 102 and second member 104. The first member 102 of the door holding and/or latching device 100 is fixed to an existing door strike plate or anywhere in internal frame pocket 504 of the door 502. In this present embodiment, the second member 104 is fixed to the free end of the first member 102.

In this exemplary embodiment, the second member 104 of the door holding and/or latching device 100 is designed with a leading edge 114 with an angled area 116 curved outwards to receive the door 502. The second member 104 of the door holding and latching device 100 to connect with the free end of the first member 102 using screws 220 (Screw A 120A and Screw B 120B);

According to the present embodiment, a door holding and/or latching device can be formed by combining the first member 102 of the door holding and/or latching device 100 with the second member 104 of the door holding and/or latching device 100 by connecting the free end of the first member 102 of the door holding and/or latching device 100 having two slots 112 (Slot A 112A and Slot B 112B) with the holes (not shown in FIG. 5) of the second member 104 of the door holding and latching device 560 using the screws 120 (Screw A 120A and Screw B 120B) for each slot 112 (Slot A 112A and Slot B 112B) to provide ab adjustment capability 118, between the first member 102 and the second member 104 of the door holding and/or latching device 100 to hold the door 502 open or closed at the prescribed distance.

Figure 6:
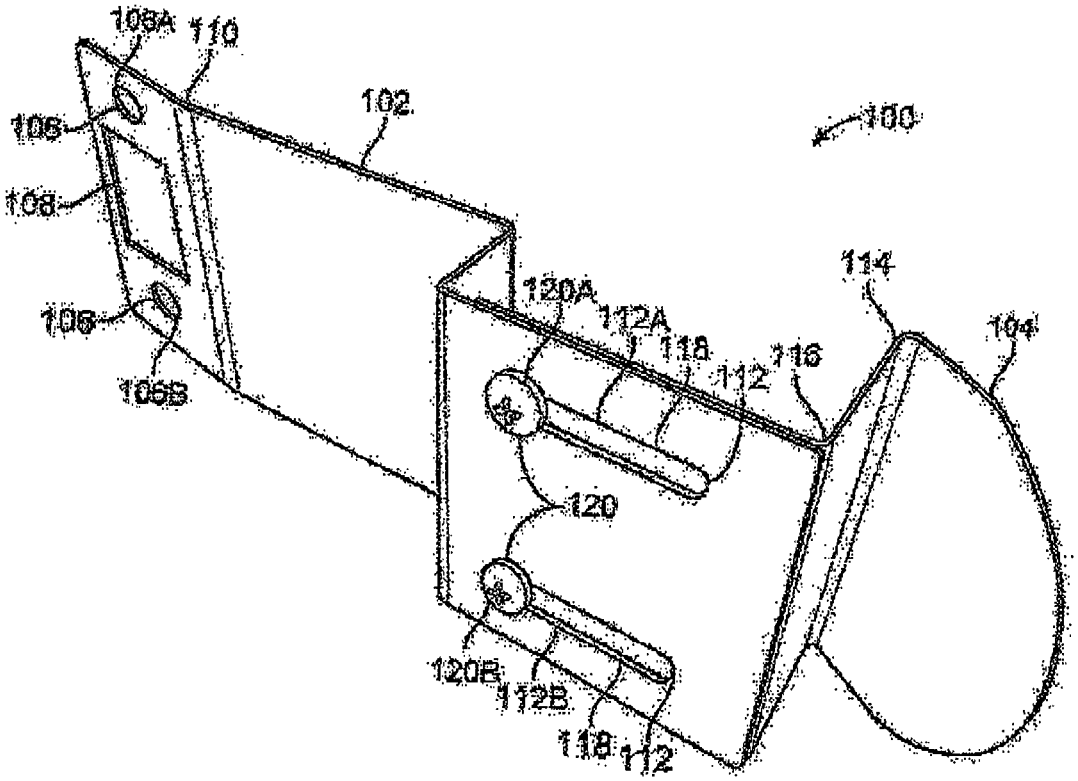
FIG. 6 illustrates a top view of an exemplary embodiment of the door holding and latching device in accordance with an exemplary embodiment of the present inventive concept.

FIG. 6 illustrates a top view of an exemplary embodiment of a door holding and/or latching device 100 in accordance with an exemplary embodiment of the present inventive concept. The door holding and/or latching device 100 includes first member 102 and second member 104. The first member 102 of the door holding and/or latching device 100 is fixed to an existing door strike plate replacing the same or is fixed anywhere in internal frame pocket of the door. In this present embodiment, the second member 104 is fixed to free end of the first member 102.

In this exemplary embodiment, the first member 102 of the door holding and/or latching device 100 contains holes 106 (First hole 106A and Second hole 106B) are provided at one end of the first member 102 to install screws with the door holding and/or latching device 100 to fix with the area defining the existing door strike plate area or anywhere in internal frame pocket of the door. An opening 108 is provided in between the holes 106 at the same end of the first member 102 of the door holding and/or latching device 100 to fix with the, existing door strike plate or anywhere in the internal frame pocket of the door. The first member 102 is slightly inclined to provide an angled area 110 to provide better flexibility for quieter operation, safety from sharp or square edges, and universal use.

In this present embodiment, the opening 108 provided in between the two holes 106 (First hole 106A and Second hole 106B) in the first member 102 of the door holding and/or latching device 100 can be of any geometric shape as described above In this exemplary embodiment, the second member 104 of the door holding and/or latching device 100 is designed with a leading edge 114 with an angled area 116 curved outwards to receive the door. The second member 104 of the door holding and/or latching device 100 is provided with the holes (not shown in FIG. 6) to connect with the free end of the member 102 using screws 120 (Screw A 120A and Screw B 120B).

According to this embodiment, the door holding and/or latching device is formed by combining the first member 102 of the door holding and/or latching device 100 with the second member 104 of the door holding and/or latching device 100 by connecting the free end of the first member 102 of the door holding and/or latching device 100 having two slots 112 (Slot A 112A and Slot B 112B) with the holes (not shown in FIG. 6) of the second member 104 of the door holding and/or latching device 100 using the screws 120 (Screw A 120A and Screw B 120B) for each slot 112 (Slot A 112A and Slot B 112B) to provide an adjustment capability 118 between the first member 102 and the second member 104 of the door holding and/or latching device 100 to hold the door open or closed at the prescribed distance, In some embodiments, referring to FIGS. 1-6, the door holding and/or latching device is formed thin enough to allow proper clearance for the door to close in the door frame pocket. The door holding and/or latching device is made of any known flexible, strong material such as sheet steel, sheet aluminum, carbon fiber, plastic or fiberglass impregnated plastic. The steel may be cut into blanks with common metal cutting tools such as laser CNC and then bent with common equipment such as bending brakes to create the proper form. It is fastened to the door pocket with screws, nails and/or adhesive of the proper size to conceal the hardware and flush to allow the door to close fully.

It should also be noted that any and all portions of the door holding and/or latching device may be formed by additive manufacturing (or 3D printing) techniques.

According to embodiments in FIGS. 1-6, adjustment capability is provided to the door holding and latching device to adjust to the swing of the door and the desired holding (spring-like) strength by bending the device in or out from the path of the swinging door. The door holding and latching device is designed with an offset in the bend so the inertia and force from the door will cause the door to pass over the device's door pocket and continue to the door pocket in the door frame to avoid damage to the device or the door pocket.

However in this present embodiment, a knob latch present in the door is locked with the existing door strike plate through the opening present in between the holes of the door holding and latching device.

It should be noted, however, that in some embodiments, the first and second members are held together through an adhesive. In some embodiments, the adhesion allows for an adjustment capability after the device is attached to the internal frame of the door. In some embodiments, the adhesive connection is permanent and the first and second members cannot be adjusted. In this case, the door holding and latching device is a non-adjustable device once installed.

In further embodiments, the holes are as many holes as needed or desired in the portion of the door holding and latching device that is attached to the internal frame of the door. That is, there may be 0, 1, 2, 3, 4, 5, 6, 7, 8, 9 or 10 holes in any configuration around the opening of the door holding and latching device that replaces the strike plate. The holes may be chamfered to help provide a better fit.

In still further embodiments, an exemplary width, length and thickness may be as follows. The width of the door holding and latching device may be about 2 to about 2.25 inches. The overall length of the door holding and latching device may be about 8 to 10 inches. When the door holding and latching device includes two separate members, one member may be about 6 to 7 inches long and the other member may be 3 to 4 inches long. The thickness of the door holding and latching device may be 0.8 mm to 2.7 mm.

According to some embodiments of the present inventive concept, the bend angle of the components of the door holding and latching device that allow the device to adjust to the swing of the door and seating of the same in the area configured to receive the door include an angled portion near the area affixed to the door frame (e.g., 210 and corresponding numbers) of 9-12°, typically 11° and an angled portion configured to receive the door (e.g., 216 and corresponding numbers) of 80-90°, typically 90°. There is also an angled portion 217 at the end opposite the angled portion near the area affixed to the door frame. This angle 217 is about 93°.

Further embodiments of the present inventive concept include colored or color-coded portions of the door holding and latching device for safety, ease of assembly, etc. Additional embodiments of the door latch apparatus include an alarm mechanism to provide notice of movement of the door holding and latching device. In some instances, the door holding and latching device may include security or safety features such as a pin, bar, chain, motion light, etc. The door holding and latching apparatus, or portions thereof, may be coated with a protective material such as silicone, plastic, etc. The device may further include a protective cap on any exposed end or surface of the device to lessen the effect of impact with a subject.

The present inventive concept satisfies the need for a door holding and/or latching device that is flexible and made of strong material and mounted in place of the existing door strike plate or anywhere in the internal frame pocket of the door to hold the door at the prescribed distance. The device may also provide an adjustment capability, and often at a very low cost. The design of this device withstands the impact of the door closing on it with a reasonable slamming force without damaging the device or the door.

The present inventive concept has been described in an illustrative manner, and it is to be understood that the terminology which has been used is intended to be in the nature of words of description rather than of limitation.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises", "comprising," "includes" and/or "including" when used in this specification, specify the presence of stated features, integers, steps, operations, elements, and/or components, but do not preclude the presence or addition of one or more other features, integers, steps, operations, elements, components, and/or groups thereof. Moreover, when an element is referred to as being "fixed" (or affixed) or "connected" to another element, it can be directly fixed or connected to the other element, or intervening elements may be present. In contrast, when an element is referred to as being "directly fixed" or "directly connected" to another element, there are no intervening elements present. As used herein the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Unless otherwise defined, all terms (including technical and scientific terms) used herein have the same meaning as commonly understood by one of ordinary skill in the art to which this inventive concept belongs. It will be further understood that terms used herein should be interpreted as having a meaning that is consistent with their meaning in the context of this specification and the relevant art and will not be interpreted in an idealized or overly formal sense unless expressly so defined herein.

Modifications and variations of the present inventive concept in light of the above disclosure may be made. It is, therefore, to be understood that such modifications and variations are within the scope of the appended claims and the invention may be practiced otherwise than as specifically described.

That which is claimed:

1. A door latching apparatus comprising:

an elongated door latch bracket comprising;

a first member comprising: a first planar end that is affixed to a door jamb via two holes such that it replaces a strike plate of a door, a planar elongated portion that extends to a first angled portion, and wherein the first angled portion extends substantially orthogonally from the planar elongated portion to a second planar end having two parallel slots, wherein the first planar end further comprises a rectangular opening;

a second member comprising: a first planar end having two holes that extends to a second angled portion, wherein the second angled portion extends substantially orthogonally from the first planar end, and a second end having a planar angled tab member that extends from the second angled portion; wherein the two holes of the second member overlap with the two parallel slots of the first member and are connected to each other by a respective screw fastener such that the second planar end and first angled portion of the first member and the first planar end and second angled portion of the second member form an adjustable substantially U-shaped door latch portion configured to engage and hold an edge of a door, wherein the angled tab member is configured to flex the elongated door latch bracket for engaging or disengaging the door with or from the substantially U-shaped door latch portion; wherein when the second planar end of the first member and first planar end of the second member are connected, the first angled portion is substantially parallel with the second angled portion; and wherein each of the first and second members has a single-piece construction.

2. The door latching apparatus of claim 1, wherein the first member and/or second member is comprised of steel, aluminum, carbon fiber, fiberglass impregnated plastic or combinations thereof.

3. The door latching apparatus of claim 1, wherein the door holding apparatus is configured to hold the door at a prescribed distance from the door frame under conditions where a user is opening or closing the door.

4. The door latching apparatus of claim 1, wherein the door latching apparatus is configured to allow the door to be in a partially or fully opened position or a closed position without removal of the door latching apparatus.

5. The door latch apparatus of claim 1, wherein the door latching apparatus is configured to be adjusted to accommodate an opening of the door end provide a desired holding strength by bending the door latching apparatus toward or away from a path of a swinging door.

* * * * *